US008061117B2

(12) United States Patent
Cheng

(10) Patent No.: US 8,061,117 B2
(45) Date of Patent: Nov. 22, 2011

(54) DYNAMIC CONTROL SYSTEM TO IMPLEMENT HOMOGENOUS MIXING OF DILUENT AND FUEL TO ENABLE GAS TURBINE COMBUSTION SYSTEMS TO REACH AND MAINTAIN LOW EMISSION LEVELS

(75) Inventor: Dah Yu Cheng, Los Altos Hills, CA (US)

(73) Assignee: Cheng Power Systems, Inc., Mountain View, CA (US)

( * ) Notice: Subject to any disclaimer, the term of this patent is extended or adjusted under 35 U.S.C. 154(b) by 1156 days.

(21) Appl. No.: 11/809,572

(22) Filed: Jun. 1, 2007

(65) Prior Publication Data

US 2008/0295520 A1 Dec. 4, 2008

(51) Int. Cl.
*F02C 9/00* (2006.01)
*F02G 3/00* (2006.01)

(52) U.S. Cl. ..... 60/39.281; 60/39.3; 60/39.26; 60/786; 60/790

(58) Field of Classification Search ..... 60/39.281, 60/39.26, 39.3, 786, 790
See application file for complete search history.

(56) References Cited

U.S. PATENT DOCUMENTS

| | | | |
|---|---|---|---|
| 3,804,579 | A | 4/1974 | Wilhelm |
| 3,921,389 | A | 11/1975 | Kawaguchi |
| 3,982,878 | A | 9/1976 | Yamane et al. |
| 4,025,282 | A | 5/1977 | Reed et al. |
| 4,041,699 | A | 8/1977 | Schelp |
| 4,110,973 | A | 9/1978 | Haeflich et al. |
| 4,147,025 | A | 4/1979 | Friendrich et al. |
| 4,189,914 | A | 2/1980 | Marek et al. |
| 4,302,177 | A | 11/1981 | Fankhanel et al. |
| 4,657,009 | A | 4/1987 | Zen |
| 5,095,693 | A | 3/1992 | Day |
| 5,163,511 | A | 11/1992 | Amundson et al. |
| 5,197,509 | A | 3/1993 | Cheng |
| 5,233,823 | A | 8/1993 | Day |
| 5,241,816 | A | 9/1993 | Drnevich |
| 5,323,661 | A | 6/1994 | Cheng |
| 5,617,716 | A | 4/1997 | Schreiber et al. |
| 5,983,622 | A | 11/1999 | Newburry et al. |
| 6,418,724 | B1 * | 7/2002 | Cheng ..... 60/775 |
| 7,104,784 | B1 | 9/2006 | Hasegawa et al. |

FOREIGN PATENT DOCUMENTS

| | | | |
|---|---|---|---|
| DE | 8008668 | U1 | 6/1986 |
| EP | 0546501 | A2 | 6/1993 |
| EP | 1217299 | A1 | 6/2002 |
| WO | WO2008/097096 | A1 | 8/2008 |

OTHER PUBLICATIONS

D. Y. Cheng, "The Distinction between the Cheng Cycle and Stig Cycle", Proc. ASME 2006 (May 8-11, 2006).
R. Peltier, "Cheng Cycle flirts with 2 ppm NOx- and CO", Power Magazine (May 15, 2006).
R. Peltier, "An encore for the Cheng Cycle?", Power Magazine (Jun. 2003).
May 31, 2011 European search report in connection with counterpart European Patent Application No. 08 25 1915.

* cited by examiner

*Primary Examiner* — Louis Casaregola
*Assistant Examiner* — Craig Kim
(74) *Attorney, Agent, or Firm* — Cooper & Dunham, LLP

(57) ABSTRACT

System, methods and apparatus for dynamic control of mixing of diluent and fuel at desired diluent-to-fuel ratios to obtain low level of undesirable emissions in a combustion system are described.

24 Claims, 9 Drawing Sheets

| Model | Air Flow (lb/sec) | Steam Flow (lb/hr) | Steam to Fuel Ratio | Heat Rate (Btu/kWh) | $CO_2$ Reduction per kWh | Power Output, kW |
|---|---|---|---|---|---|---|
| Frame 5P | | | | | | |
| No Steam | 270 | 0 | 0 | 11,780 | 0 | 26,175 |
| CLN Steam | 270 | 52,195 | 3 | 10,055 | 17.10% | 31,160 |
| Frame 6B | | | | | | |
| No Steam | 305 | 0 | 0 | 10,440 | 0 | 39,210 |
| CLN Steam | 305 | 68,625 | 3.14 | 8,840 | 18.10% | 48,160 |
| Frame 7EA | | | | | | |
| No Steam | 658 | 0 | 0 | 10,985 | 0 | 82,825 |
| CLN Steam | 658 | 143,550 | 3.11 | 9,100 | 20.70% | 99,065 |
| W 251 | | | | | | |
| No Steam | 389 | 0 | 0 | 10,465 | 0 | 50,615 |
| CLN Steam | 389 | 83,860 | 3.21 | 8,710 | 20.10% | 58,460 |
| W 501D5 | | | | | | |
| No Steam | 863 | 0 | 0 | 10,690 | 0 | 109,055 |
| CLN Steam | 863 | 184,975 | 2.95 | 8,795 | 24.60% | 139,070 |

Figure 9.

DYNAMIC CONTROL SYSTEM TO IMPLEMENT HOMOGENOUS MIXING OF DILUENT AND FUEL TO ENABLE GAS TURBINE COMBUSTION SYSTEMS TO REACH AND MAINTAIN LOW EMISSION LEVELS

TECHNICAL FIELD

This disclosure relates to combustion systems, and more particularly to dynamic control for reducing emissions in combustion systems.

BACKGROUND

The reduction of emissions, in particular, greenhouse gas $CO_2$ and air pollutants such as $NO_X$, from combustion systems is very much in the fore-front of concern regarding earth's environment. During operation of conventional combustion systems, variable factors such as (but not limited to) dynamic load changes and rapid fuel heating value changes can be experienced by the combustion system. When high diluent-to-fuel ratios are used as a means for achieving low level emissions in combustion systems, variable factors such as dynamic changes in load and varying fuel heating values can produce undesirable effects of turbulence in a diffusion flame, production of emissions above a desired level and flameout. There is a need for improvements to efficiency and methodology for reducing such emissions in combustion systems (such as power plant combustion systems).

BRIEF SUMMARY

This disclosure describes a system, apparatuses and methodologies for dynamically controlling (preferably in real time) emissions from combustion systems and maintaining emissions at a low level in accordance with emission regulations and other requirements.

In one aspect of this disclosure, a dynamic control system is provided for a combustion system, operating within a time frame in which the combustion system operates and actively controlling a flow of diluent to be homogenously mixed with fuel. The diluent is defined as a chemically inactive (inert) fluid in the combustion zone, such as nitrogen, $CO_2$, Argon, Helium, and steam etc. The dynamic control system maintains the flow of diluent at a rate which, when the diluent is mixed homogeneously with fuel, produces a mixture with a desired diluent-to-fuel ratio so that combustion of said mixture produces emissions below a desired level.

In another aspect of this disclosure, a method is provided for dynamically controlling the flow of diluent to be mixed with fuel to a homogenous concentration prior to combustion. In a preferred embodiment, flow parameters of the diluent and fuel are continuously monitored and used in computing the appropriate flow of diluent to be mixed with fuel so that a mixture with the desired ratio of diluent-to-fuel is created. The diluent and fuel are then thoroughly mixed to a desired level of homogeneity (for example, greater than 97.5%) before injection into a flame zone for combustion, thereby achieving optimal low level emissions (of, for example, $NO_X$).

In another aspect of this disclosure, a dynamic control system maintains low level emissions while sustaining flame stability in the combustion system. In a preferred embodiment of the dynamic control system, flame stability at diluent-to-fuel ratios above 3.0:1 is provided.

In another aspect, an apparatus for reducing emissions in a combustion system is provided which comprises a dynamic control unit, one or more sensors to measure flow parameters of the components to be mixed such as those of diluent and fuel, and flow controllers for physically controlling the flow of diluent in the system. The one or more sensors measure flow parameters (such as temperature, pressure, and flow rate) and transmit this information to the dynamic control unit which in turn determines the appropriate flow of diluent, which when mixed with fuel produces a mixture at a desired diluent-to-fuel ratio for low level emissions in combustion. The apparatus preferably comprises a static mixer element and a Cheng rotation vane element where the combined effect of these elements produces a mixture with homogeneity preferably higher than 99%.

BRIEF DESCRIPTION OF THE DRAWINGS

The features of the subject matter of this disclosure can be more readily understood from the following detailed description with reference to the accompanying drawings wherein:

FIG. 9 is a table of data showing $CO_2$ reduction and power output increases from dynamic control in accordance with a preferred embodiment, in actual gas turbine combustion systems

DETAILED DESCRIPTION OF THE PREFERRED EMBODIMENTS

Figure 1:
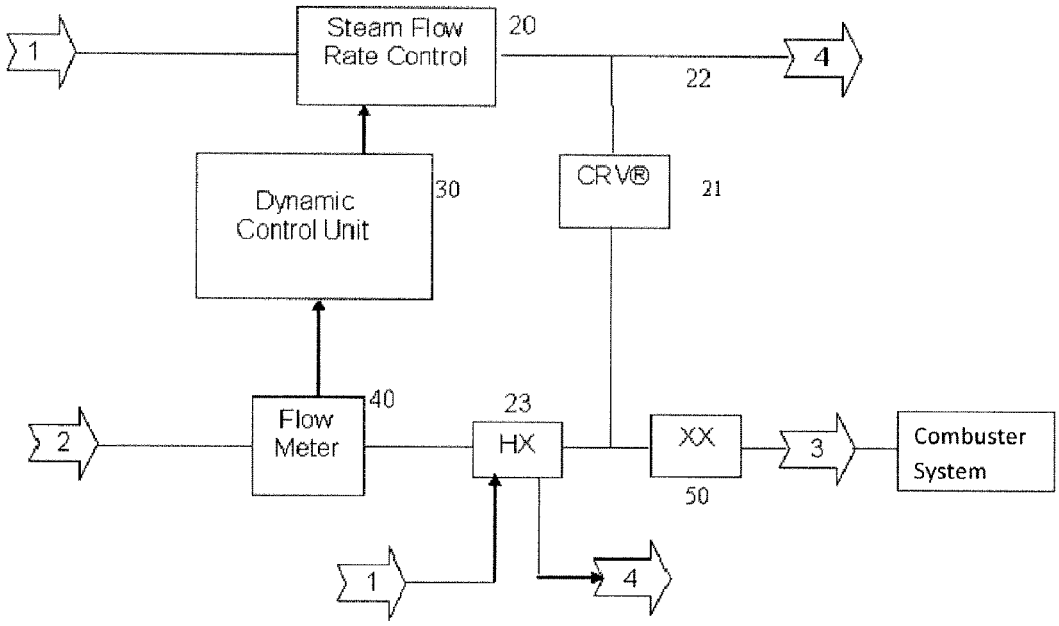
FIG. 1 illustrates a block diagram for a dynamic control system, according to an exemplary embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. In addition, a detailed description of known functions and configurations will be omitted when it may obscure the subject matter of the present invention.

This disclosure is directed to dynamic control in a gas turbine combustion system to enable emissions to be maintained at a low level from the system and enable flame stability to be sustained. A dynamic control system, in accordance with a preferred embodiment of this disclosure, controls diluent flow and fuel flow to maintain a desired diluent-to-fuel ratio at a specific homogeneity given certain measured fuel flow and diluent flow parameters, and as a consequence limit emissions of $NO_X$ and CO to below a pre-set level. The flow of diluent is dynamically adjusted according to time varying parameters measured in such a dynamic control system to maintain this diluent-to-fuel ratio. The homogeneous mixing of diluent and, for example, gaseous fuel is preferably maintained to a level of homogeneity of 97% or higher through use of one or more static mixers and optionally one or more pre-mixer elements (for example, a Cheng rotation vane).

In using this dynamic control system to achieve emission control in the range below 15 ppm $NO_X$, an example can be given in which the fuel is natural gas and the diluent is steam. The steam-to-fuel ratio would be 2:1. If the $NO_X$ level is below 5 ppm, the steam-to-fuel ratio would be in the range 2.75:1 to 3.0:1. Also, it has been demonstrated that this system can produce $NO_X$ level to below 2 ppm with steam-to-fuel of 3.7:1 to 4.2:1. At these low emission levels with high steam-to-fuel ratio the homogeneously mixed fuel and steam would have a heating value below 300 Btu per SCF down to below 200 Btu per SCF. A flame was maintained by implementation of a dynamic control system. A rapid change of mixture ratio normally triggers flame-out; therefore a comprehensive dynamic control is implemented using an appropriate hardware and software combination to maintain flame stability. The software in this embodiment (copyright registration number TXul-327-484, Nov. 14, 2006, hereby incorporated by reference) controls the system during startup and shutdown procedures.

There are circumstances during operation of real combustion systems where maintaining such a high level of homogeneity is not desirable, which must be taken into account by any implementation of a dynamic control system for low level emissions. In real combustion systems there are dynamic changes during startup and shutdown. For example, an embodiment of the disclosure herein where the diluent is steam, could comprise a dynamic control system implemented for emission control on a gas turbine with a waste heat boiler (Heat Recovery Steam Generator, HRSG) where it is recommended to start the engine without diluent. In this case if the HRSG is stone cold there will be no steam available to mix with the fuel; however, such a transient period can be programmed in the dynamic control system to accommodate the allowed start up time as specified in the emission permits. In another embodiment, during shutdown of a combustion system such as a gas turbine it is preferable to shut off the steam source prior to the scheduled shut down so that no condensate will be left in the combustion system.

Another aspect of the preferred embodiment is its ability to handle load changes experienced during operation of a combustion system. The load may be varied due to the time of the day and process requirements. Any change of load or equivalently change of fuel flow requires a rapid follow-through of steam flow change to maintain a preset steam-to-fuel ratio to maintain a set level or range of emissions. As a preferred embodiment a temporary change of steam-to-fuel ratio can be to a slightly lower steam-to-fuel ratio side rather than higher, in order to maintain flame stability. In particular when the load is reduced suddenly, fuel flow can be cut back. The dynamic impact is a temporarily high steam-to-fuel ratio. If the steam-to-fuel ratio is already high, for example in the range of 3.0:1 to 4.0:1, this may trigger a flame out. A dynamic control preferably is implemented in such a way as to limit such events to an extremely short time or eliminate them.

In another embodiment, the dynamic control system dynamically corrects the mixing of diluent and fuel to accommodate varying heating values such that stability of the combustion system is maintained. Certain gaseous fuels being considered for the future are biomass or coalbed methane. The heating value per cubic foot of such fuels as well as others can change from time to time, often more rapidly than desired for use in combustion systems.

To implement the desired conditions described above, an embodiment of the dynamic control system has been built and tested on real engines. Such a system is constructed to follow industrial standards for pressure vessel code and safety. As is the case in the preferred embodiment, steam is used as diluent for the combustion system; and if the source of the steam is a HRSG, steam recovered from the exhaust pipe of the combustion turbine increases efficiency of the turbine or lowers fuel consumption per MWH generated. Lowering of fuel heat rate is a means of reducing $CO_2$ emissions for each MWH of power generated; therefore this is a system which reduces greenhouse gas.

FIG. 1 is a block diagram showing the configuration of an embodiment of the dynamic control system. Steam provided by a steam source 1 enters a steam flow rate control block 20 that is in turn controlled by a dynamic control unit 30. The dynamic control unit 30 stores information for relevant control parameters and receives a signal from the fuel flow meter 40 indicative of flow of fuel from fuel source 2. The illustrated system does not control fuel flow; fuel flow is controlled by an inherent combustion system separately. As an optional example, the fuel will enter a heat exchanger 23 to pre-heat the fuel to an elevated temperature. The heat exchanger 23 receives steam from a steam source for heating the fuel and drains the used steam and/or condensate at the exit arrow 4. The steam flow goes into a control valve 22 for startup bleeding until the steam is totally dry and the piping system has been heated up. The shutoff valve 22 is now closed. The steam enters a CRV® fluid conditioner 21 to assist mixing with the fuel exiting the heat exchanger. The steam-fuel mixture enters a static mixer 50 labeled XX where more thorough mixing takes place and exits at conduit 3, from which it enters the fuel manifold and then fuel nozzles for the combustion system (not seen in FIG. 1).

It should be understood that dynamic control unit 30 can be a computer (for example, a personal computer, a workstation computer, etc.) configured with software and/or additional hardware (for example, one or more plug-in boards) to implement the functions of the dynamic control unit as described herein.

Figure 2:
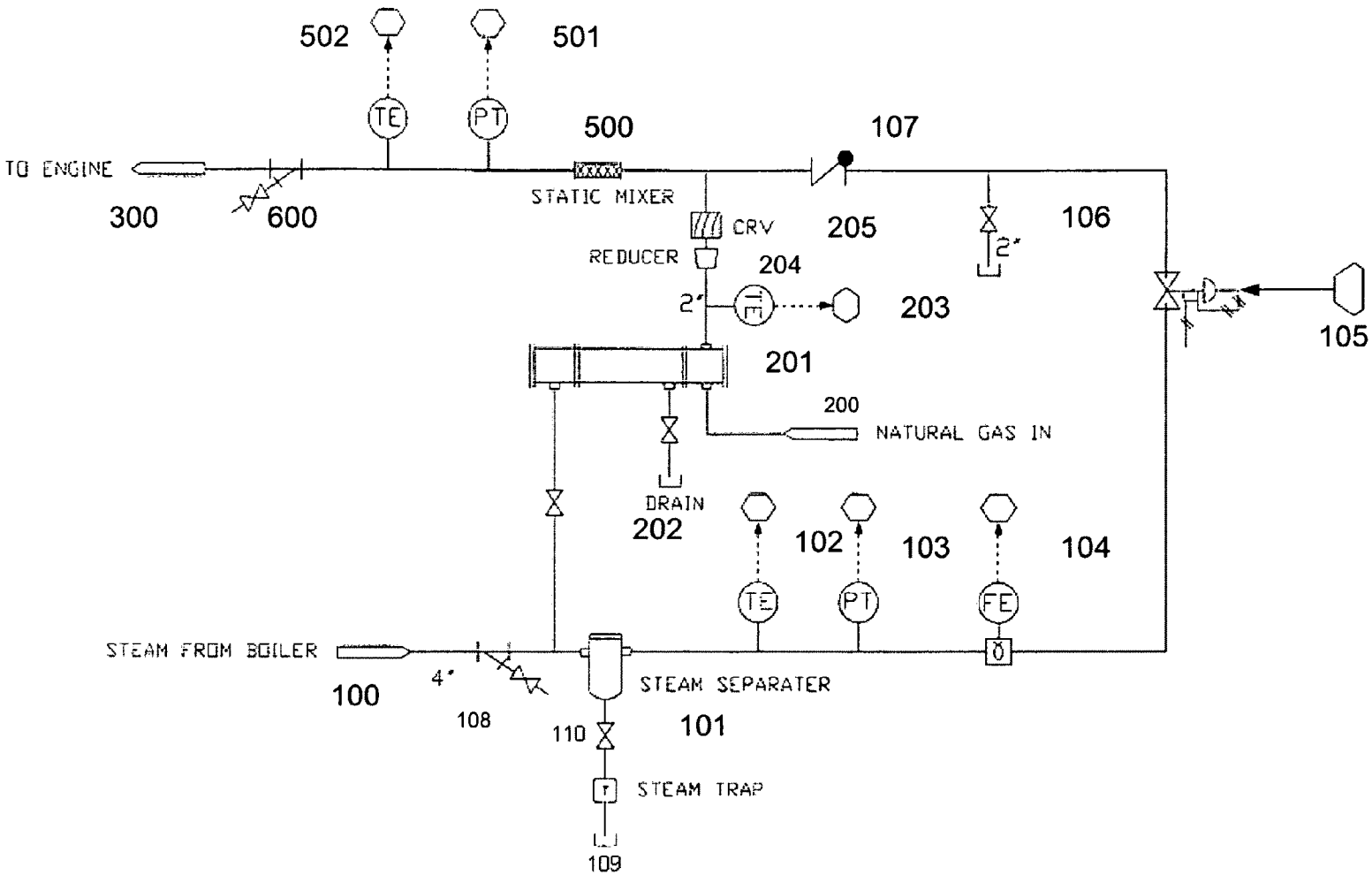
FIG. 2 is an example of a comprehensive piping and instrumentation diagram, illustrating built in safety features for meeting industrial safety codes.

FIG. 2 is a piping and instrument diagram which describes instrumentation and hardware implementing an embodiment of the dynamic control system disclosed herein. Steam enters at a flange 100 and goes through a y strainer 108 to remove carry-over particulates. If the steam is at a saturated state it enters a steam separator (dryer) 101 which has a drain 109 for condensate. A drain valve 110 is operated dependant on accumulation of liquid, otherwise it is left closed. Steam flow quantity is measured by temperature and signal transmitter 102 and a pressure gauge 103, and the flow rate is measured by a flow meter and transmitter 104. Temperature and pressure determine the density of the steam, and the velocity of a known cross section of the steam flow together with the density determines the mass flow of the steam. Downstream of the measurement system is the control valve 105 which receives signals calculated by a computer to set steam flow. The steam then enters a check valve 107 before mixing with fuel. Between the check valve 107 and control valve 105 there is a manual drain valve 106 to drain condensate during startup. The fuel enters the system through a flange 200. It enters a heat exchanger 201 which receives steam from the steam source through flange 100 and the condensate is drained automatically at 202. This heated fuel is measured by a flow measuring device 203. It is the preferred method to use a CRV® 205 to give better mixing of fuel and steam at the T junction before mixing in a static mixer 500 to a homogeneity of preferably 97% or higher. Final mass flow is monitored by a flow measurement system 501 and 502 before entering a combustion system 300. A y strainer 600 is optional. A heat exchanger to heat the fuel is also optional.

Figure 3:
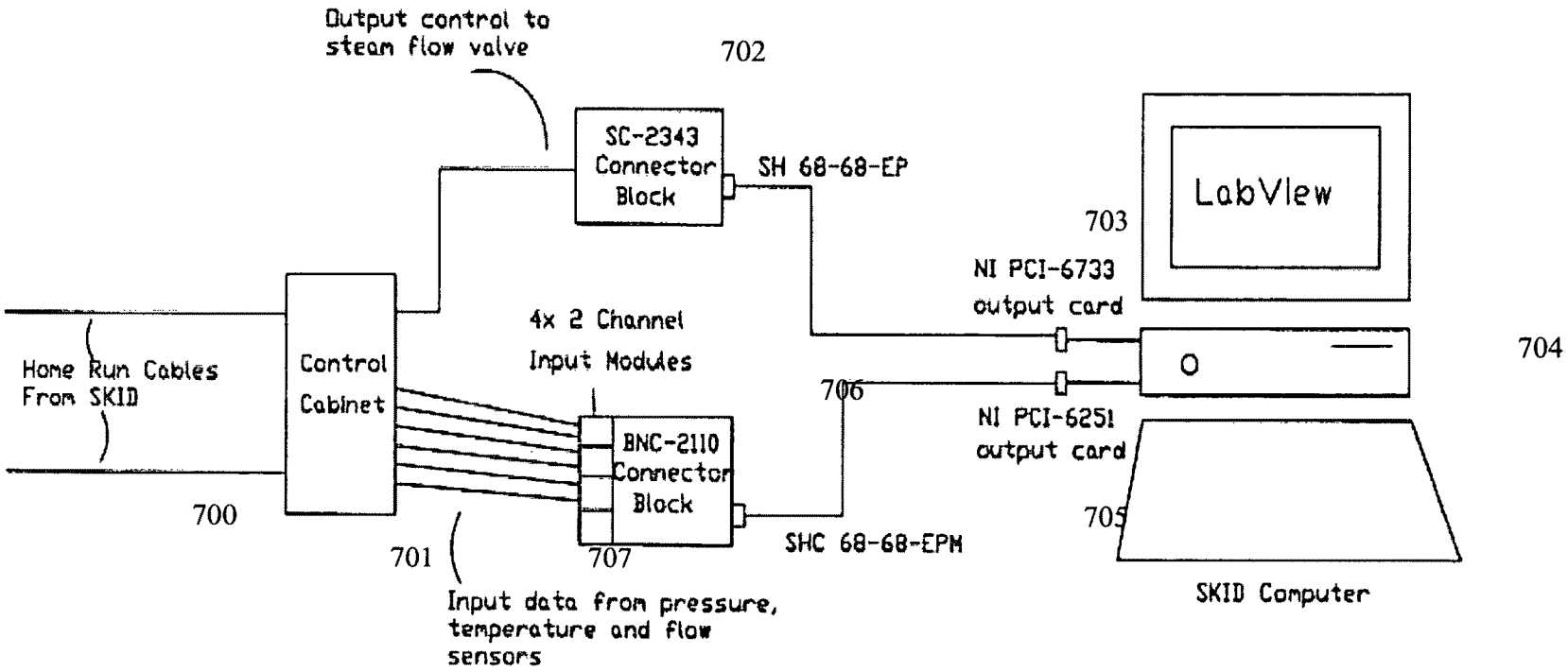
FIG. 3 illustrates a block diagram of a dynamic control system, according to another exemplary embodiment.

FIG. 3 illustrates a block diagram of an exemplary embodiment of a dynamic control system. Home run cables 700 lead from a skid to a control cabinet 701 which contains a connector block 702 for the steam valve control wire from which a cable connects to a card 703 in a computer 704. The control cabinet also contains a BNC connector block 706 which collects the transmitter data from the home run cables via BNC cables 707, and connects via a computer cable to a PCI card 705 in the control computer 704.

Figure 4:
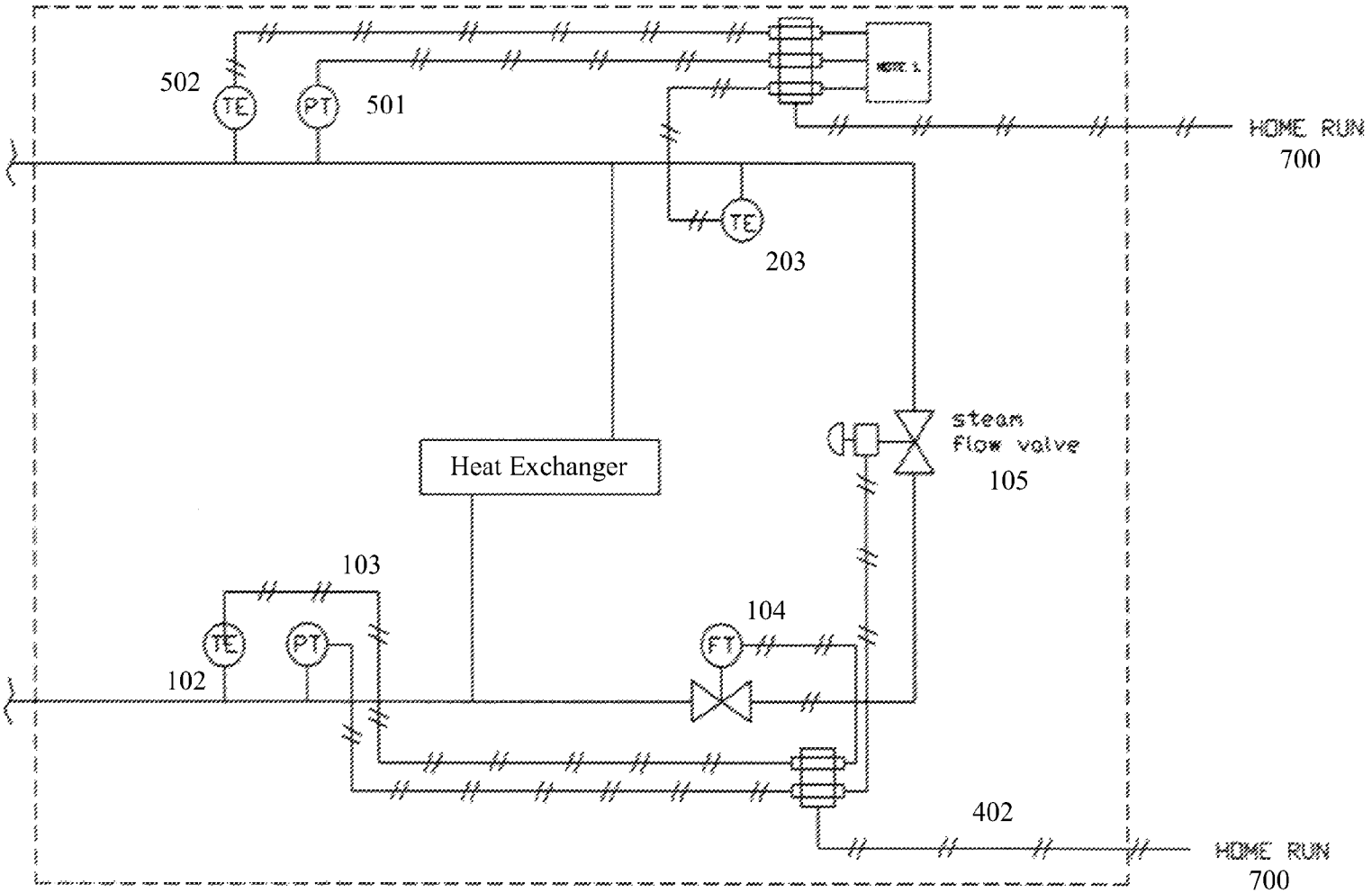
FIG. 4 shows a wiring diagram for an embodied control system.

FIG. 4 shows wiring for an embodiment of the apparatus in the dynamic control system. Home run cables 700 that go to the control cabinet lead off from connector blocks on a skid 401 and 402 to which cables run from temperature emitter instruments 502, 203, and 102, and from pressure emitter instruments 501, 103 and from the flow meter 104, and to the steam control valve 105.

Figure 5:
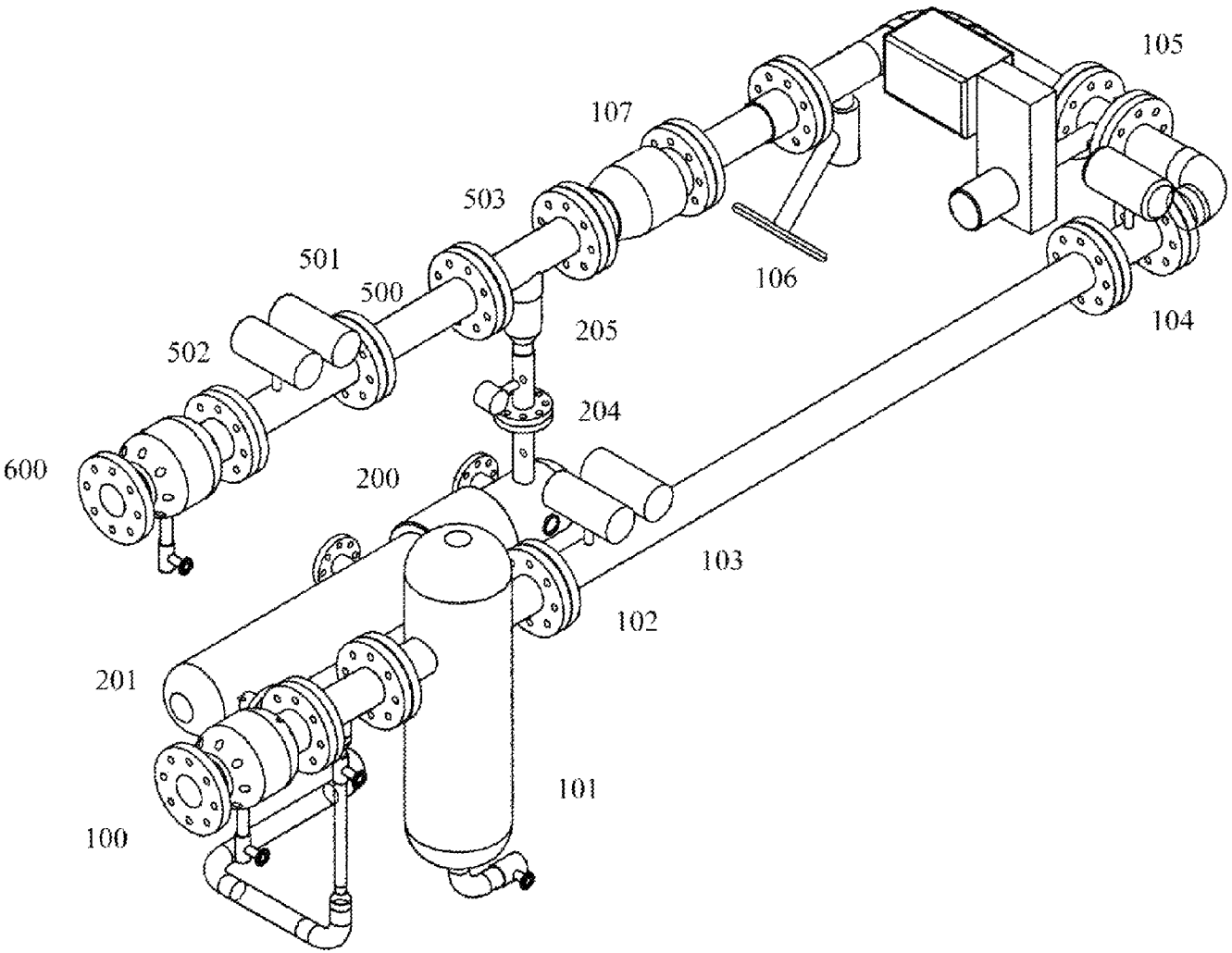
FIG. 5 illustrates a perspective view of hardware, in an exemplary embodiment.

FIG. 5 is a three dimensional drawing showing a preferred embodiment of the apparatus for the dynamic control system as-built. Steam enters at flange 100 combined with an optional Y strainer 100 and then proceeds to a steam separator 101. Pressure and temperature transmitters 102 and 103 are placed on the pipe that emerges from the separator 101, and after a reasonably long length of straight pipe there is a flow meter 104, followed by a steam control valve 105. A blowdown valve 106 may be placed next, then a check valve 107 to stop fuel getting backwards into the steam system. Fuel enters the steam pipe at a T junction 503. It is the preferred method to use a Cheng Rotation Vane (CRV®) 205 to give better mixing of fuel and steam at the T junction before mixing in the static mixer 500 to homogeneity of preferably 97% or higher. A pressure and a temperature transmitter 501 and 502 are situated after the mixer and then the steam/fuel mixture exits at an optional y strainer 600.

The dynamic control system described herein was operated experimentally in a gas turbine combustion system and observed to produce an increase in gas turbine efficiency. An increase in output as compared to the same gas turbine combustion system combusting only fuel can be attributed to a high diluent-to-fuel ratio in the combusted mixture of the gas turbine combusted system. Under other settings of the dynamic control system, fuel consumption was reduced yet the same level of output was produced and observed. Thus, it was demonstrated that use of the system led to reduction in the emission of $CO_2$ greenhouse gas produced from the combustion of hydrocarbon fuel.

Figure 6:
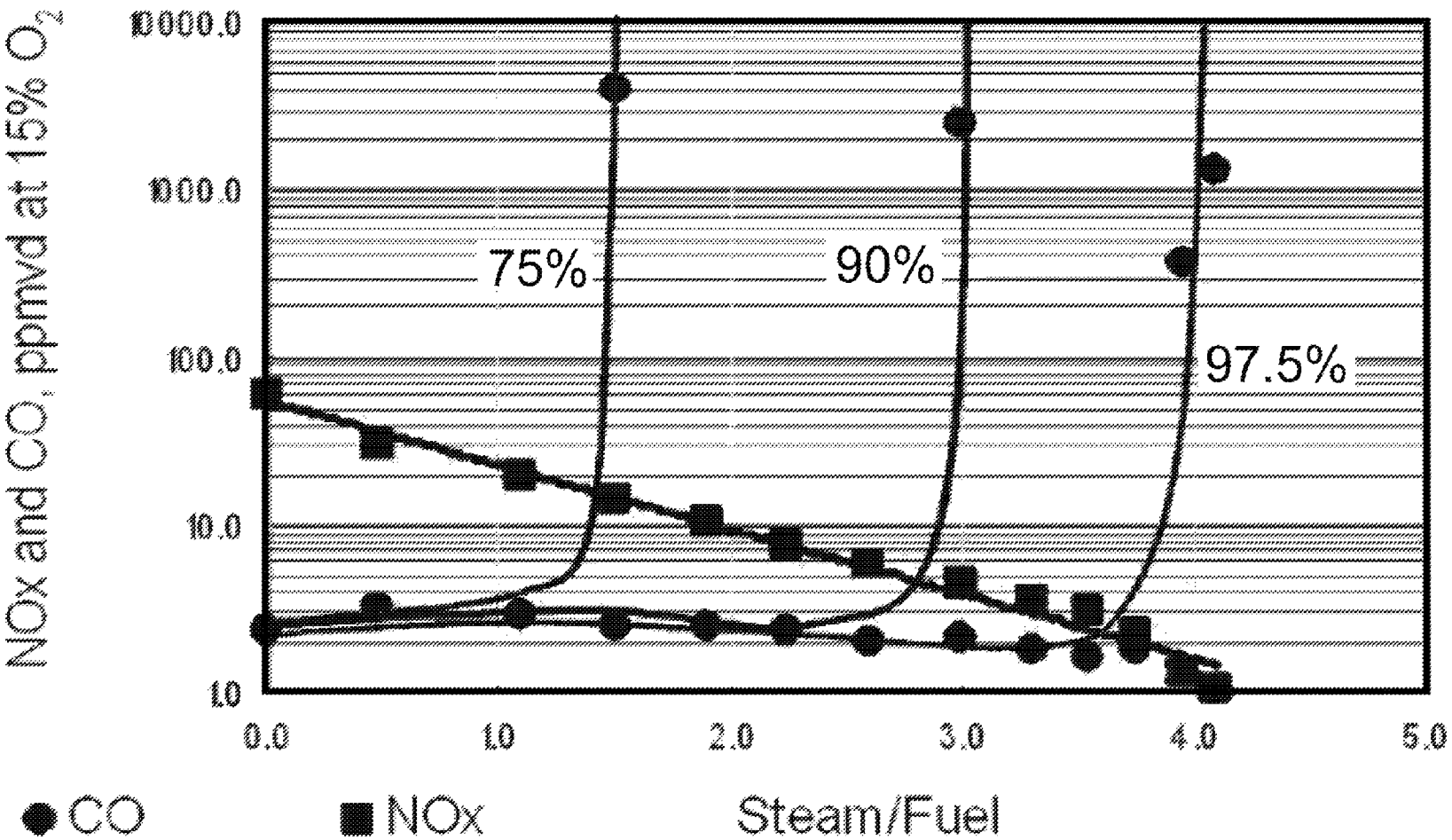
FIG. 6 shows a plot of $NO_X$ vs. steam-to-fuel ratio wherein the stability is bounded by high CO emissions at different levels of mixture homogeneities.

FIG. 6 is a plot of experimental data showing a relationship between $NO_X$ and CO emissions with homogeneity of 75%, 90% and 97.5% on the one hand and steam-to-fuel ratio on the other hand. One can see that the homogeneity level needs to be as high as practical. The preferred embodiment is to have homogeneity of at least 97.5%, but for very low $NO_X$ emission levels homogeneity should preferably be 99%. As indicated in the experimental results, without a static mixer the typical homogeneity level is 75%. A CO concentration rise occurs at a steam-to-fuel ratio of around 1.4 to 1. That is where most of the power steam $NO_X$ control system stops. When the homogeneity level reached 90% the CO rise starts at a steam-to-fuel ratio of 2.5. When the homogeneity level is at 97.5%, the CO rise occurs at about 3.75 steam-to-fuel ratio. Those homogeneity levels vary with the total mass flow, with onset of hardware in most applications variation is built into the dynamic control system.

Figure 7:
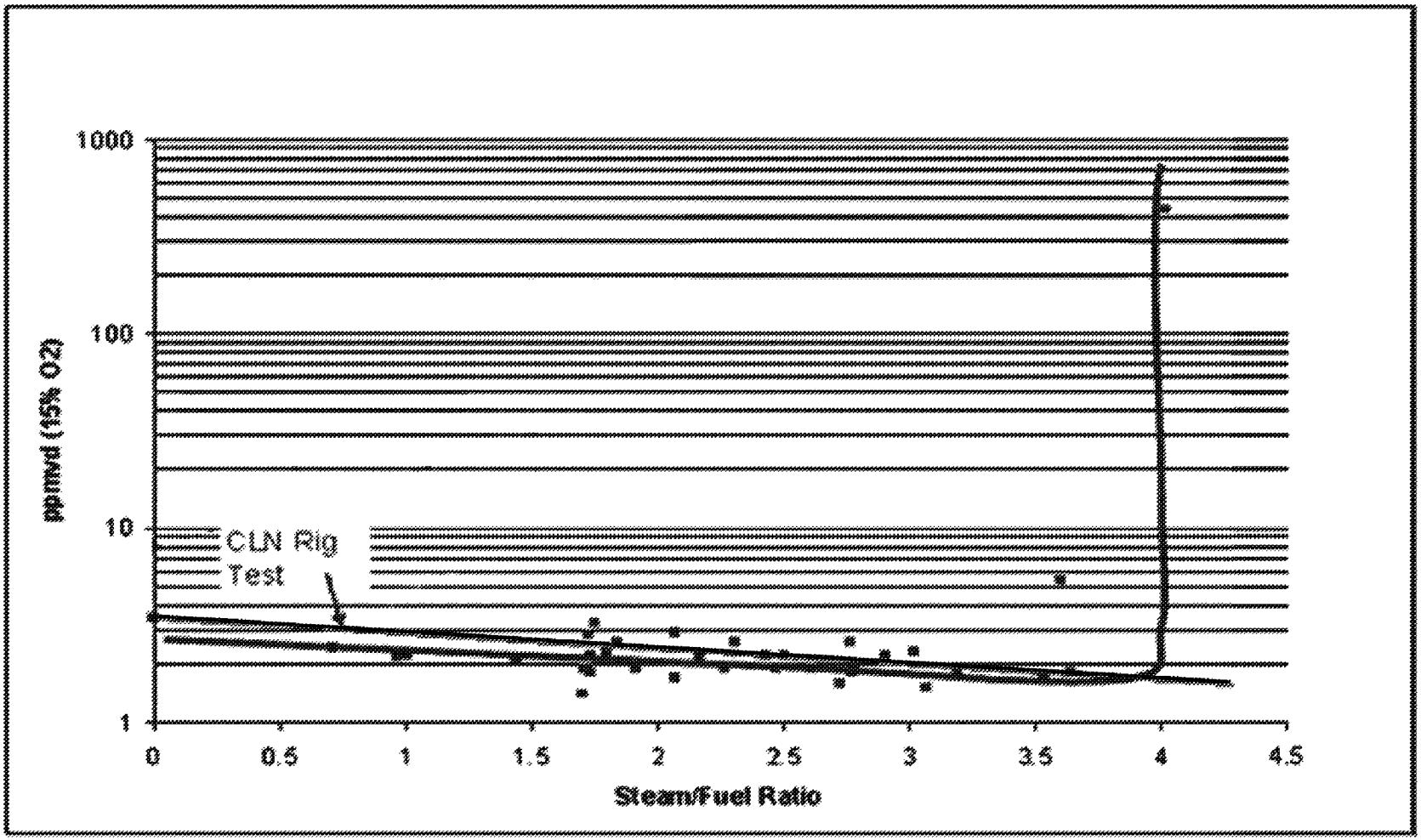
FIG. 7 shows a plot of CO vs. steam-to-fuel ratio wherein stability is bounded by high CO emissions at homogeneity of 99%.

FIG. 7 is a plot of CO emissions vs. steam-to-fuel ratio data collected from a system implementing an embodiment of the dynamic control system disclosed herein. The plot of the CO emissions in this CLN® rig test implementing dynamic control shows that at homogeneity of 99%, CO rise occurs at about a 4:1 steam-to-fuel ratio.

Figure 8:
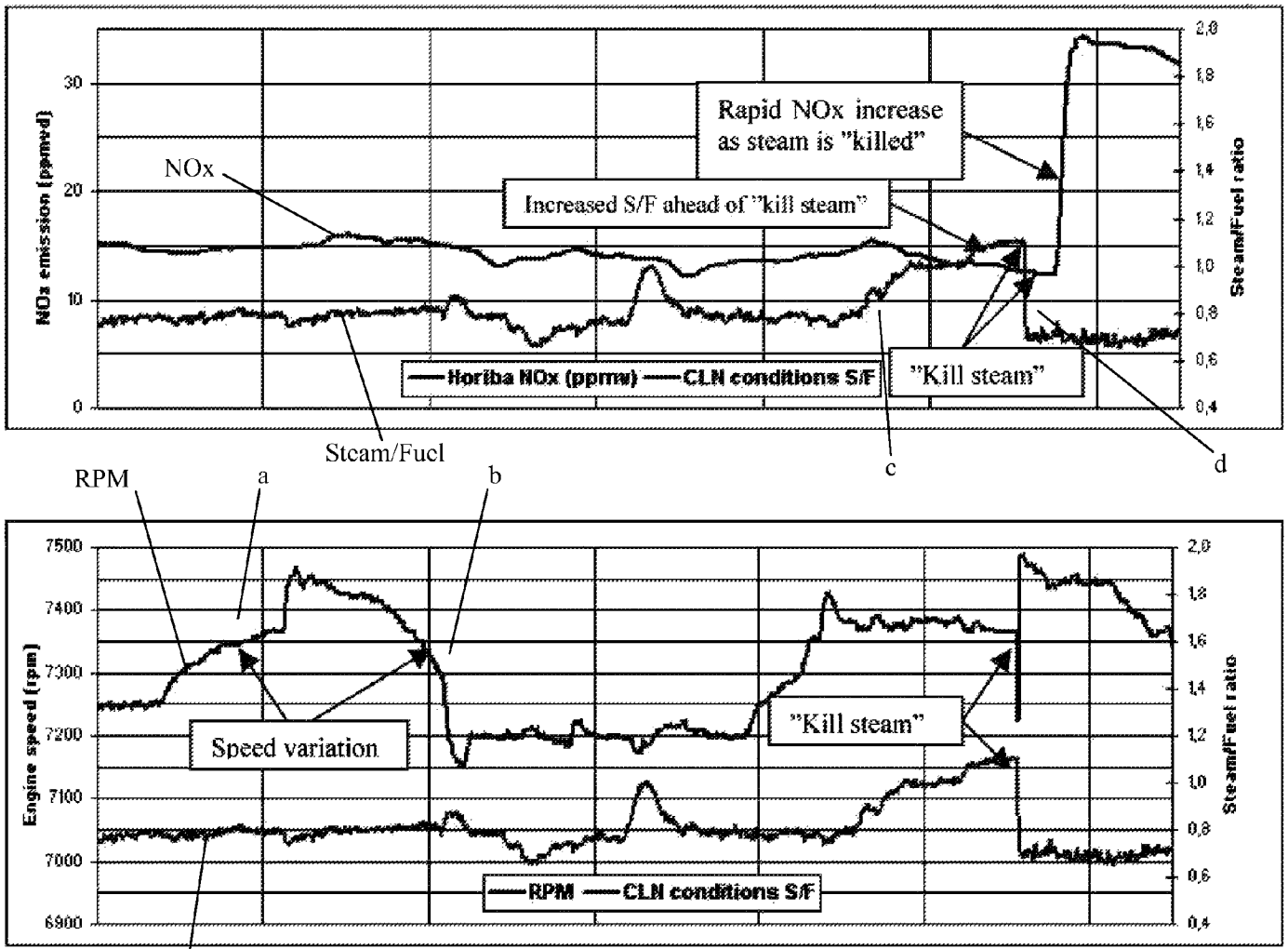
FIG. 8 shows a plot of $NO_X$ emissions, engine speed, and steam-to-fuel ratio vs. time.

FIG. 8 shows the dynamic response of the control system as an example of testing a real engine, the RR Avon 1535. This is a real time dynamic response test for the current invention. The horizontal scale is a time line: the top half of the figure shows the values of $NO_X$ and steam-to-fuel ratio and how they change in real time. Along the time line there are several events which can be described thus: (a) the fuel flow increases because of increase of load. The steam-to-fuel ratio remained approximately constant and $NO_X$ remains constant. (b) This is followed by a return to the original load condition with an overshoot then back to a constant steam-to-fuel ratio. (c) This is in turn followed by an increase in steam flow to increase steam-to-fuel ratio during which the $NO_X$ comes down, which is then (d) followed by a sudden loss of steam to test the transient conditions and the system response. The bottom part of FIG. 7 represents the rpm of the RR Avon 1535 gas compressor. The sudden increase of load can be seen as an increase of rpm. As shown there is speed variation followed by a sudden drop of rpm with a small blip below the original rpm. Correspondingly the steam-to-fuel ratio remains constant through this transient however with a slight increase of steam-to-fuel ratio due to the rapid increase of steam flow. This is followed with an increase in steam-to-fuel without increase of fuel flow which is again reflected by rpm increase of the gas compressor, indicating that an increase of steam flow at steady fuel flow will increase the capability of the gas turbine to put out more power. This transient condition is followed by a sudden steam cutoff. The fuel flow response to this is not controlled by our software but by the inherent engine control; when steam is lost there will be a sudden increase in fuel flow which causes an increase in rpm followed automatically by a decrease of rpm as the system strives to maintain constant load condition.

FIG. 9 shows data from actual implementation of the preferred embodiment of the disclosure herein on numerous gas turbine combustion engines. The data shows $CO_2$ reduction per kWh and power output in kW when a dynamic control system disclosed herein is used to implement the method of $NO_X$ emission reduction disclosed in U.S. Pat. No. 6,418,724. It is observed in all gas turbine combustion engines tested that there is a $CO_2$ reduction per kWh when the dynamic control system is implemented. Furthermore, there is an observed increase in power output when the dynamic control system is implemented.

The preferred embodiment of the dynamic control system for $NO_X$ emission incorporates a dynamic control unit comprising an electronic computer and operator. In this embodiment the electronic computer interfaces with feedback signals from fluid flow measuring devices in order to maintain desired combustion conditions so as to keep to specified $NO_X$ emission limits. Note that the control system only controls the steam flow. The computer system receives the assignment of steam-to-fuel ratio from the operator, then detects fuel flow and computes a desired steam flow rate in order to maintain the desired steam-to-fuel ratio prior to being mixed homogenously. This design makes the dynamic control system autonomous from the main gas turbine control system. In other words, no signal necessarily has to be tapped into the main logic of the combustion system. Control is passive in terms of fuel flow so it will not trigger the feedback oscillations of typical control systems. Also note, that a main feature of this embodiment is to use check valves to prevent fuel getting into the steam system. Another important feature is the use of a Cheng Rotation Vane to pre-mix the steam and fuel prior to entering the static mixer as a result of which homogeneity is increased.

The software for this embodiment of the dynamic control system essentially handles the dynamic problem of combustion stability which is different from the increased/decreased load problem. It builds startup and shutdown logic into the system such that during those periods steam is cut off first in order to stabilize the combustion process and to assure no steam will be left in the fuel manifold after the shutdown. During startup, after the gas turbine has reached a stable condition and with load, steam is allowed to enter the system for emission control. There is a built-in time delay to allow a gradual increase of steam flow to maintain homogeneity during the transient. It is desirable to have a transition period during which steam flow gradually decreases prior to shutdown, followed by total shut off of steam. After a time delay the shut-down procedure of the regular combustion system should follow. The advantage is a fully automated operation without manual attention from the operator of the current system.

In regards to applicability, the preferred embodiment of the current disclosure can successfully administrate low $NO_X$ emission control as described in U.S. Pat. No. 6,418,724, hereby incorporated by reference so as to automatically handle dynamic transients. The high achievable flame stability allows the system to safely go up to a steam-to-fuel ratio of 4:1. From the transient measurement in FIG. 7 one can see that just by increasing the steam flow (as indicated by increased steam-to-fuel ratio) the gas turbine rpm is increased. This represents a higher output with the same fuel flow, in other words it has decreased the amount of hydrocarbon fuel burned for the same unit energy output. Since the greenhouse gas $CO_2$ is formed by burning hydrocarbon fuels, this means the high steam-to-fuel ratio condition not only lowers $NO_X$ emission but also is a means of reducing greenhouse gas $CO_2$ emissions. At those high steam-to-fuel ratios ordinary prior art technology would not have had a sustainable combustion. Due to the technology disclosed in commonly-owned U.S. Pat. No. 6,418,724 the flame typically remained stable at steam-to-fuel ratio beyond 2:1. However the flame stability becomes fragile as you move up to higher steam-to-fuel ratios. The system can use built in time steps to prevent flame-out in transitional periods and other dynamic operating conditions. The above described system has been tested in real engines to provide experimental results and to show the commercial value of the invention.

The specific embodiments and examples described above are illustrative, and many variations can be introduced on these embodiments without departing from the spirit of the disclosure or from the scope of the appended claims. For example, elements and/or features of different examples and illustrative embodiments may be combined with each other and/or substituted for each other within the scope of this disclosure and appended claims.

What is claimed is:

1. An apparatus sustaining flame stability and countering flame-out in transient conditions in a gas turbine combustion system having a main control system, wherein:

said gas turbine comprises:

a diluent source, a diluent flow rate control unit receiving diluent from said diluent source and delivering diluent at a controlled rate, a fuel source, and a diluent-fuel mixer receiving diluent through said diluent flow rate control unit and fuel from said fuel source, said mixer being configured to homogenously mix the received diluent and fuel to thereby provide a homogeneous mixture thereof, a combustor having a flame zone, and a coupling between said mixer and said combustor configured to introduce said mixture into said flame zone for combustion; and said apparatus sustaining flame stability and countering flame-out comprise the following elements operable autonomously of the gas turbine combustion system main controls:

one or more measuring elements configured to measure parameters of said diluent and said fuel prior to and after the mixing thereof by said mixer;

a programmed, computer-implemented dynamic control unit communicating with said one or more measuring elements and with said diluent flow rate control unit, said dynamic control unit being configured to accept measurements from said measuring elements as inputs;

said programmed, computer-implemented dynamic control unit being further configured to use said measurements to respond to transient conditions through dynamically changing diluent-to-fuel ratios to thereby maintain diluent-to-fuel ratios countering flame-out by:

(a) during shutdown procedures and prior to complete shutdown of the gas turbine combustion system, gradually decreasing the diluent flow mixing with said fuel until there is no diluent flow into the gas turbine combustion system, and thereafter following a time delay to complete the shutdown procedures of the combustion system; and (b) during startup procedures of the gas turbine combustion system, to delay the flow of said diluent into the gas turbine combustion system and then gradually increase the flow of diluent into the combustion system and thereby stabilize the combustion process until the combustion system reaches steady-state operation with;

said programmed, computer-implemented dynamic control unit being still further configured to control the flow of diluent to the combustion zone in steady-state operation of said gas turbine to maintain a diluent-to-fuel ratio of said homogenized mixture producing $NO_X$ emissions below a pre-set level when said mixture is combusted in said combustor.

2. The apparatus of claim 1, wherein said dynamic control unit is further configured to maintain flame stability during dynamic variations of load conditions and sudden changes in fuel heating value occurring in low BTU fuels including coal bed methane and biomass produced fuel to thereby resist flameout.

3. The apparatus of claim 1, wherein said diluent comprises steam.

4. The apparatus of claim 1, wherein said diluent flow rate control unit comprises a control valve.

5. The apparatus of claim 1, wherein one or more check valves are used to prevent said fuel from entering flow pathways of said diluent.

6. The apparatus of claim 1, wherein said dynamic control unit is further configured to control said diluent flow autonomous from manual control and autonomous from a control system of said gas turbine combustion system.

7. The apparatus of claim 1, wherein said mixer comprises one or more static mixer elements and a rotation vane element.

8. The apparatus of claim 1, wherein said mixer is configured to provide said mixture at a homogeneity greater than 99% including during transient conditions.

9. The apparatus of claim 1, wherein said mixer is configured to provide said mixture at a homogeneity greater than 97.5% including during transient conditions.

10. The apparatus of claim 1, wherein said mixer is configured to provide said mixture at a homogeneity greater than 90% including during transient conditions.

11. The apparatus of claim 1, wherein said one or more measuring elements comprise elements measuring temperature, pressure, and flow rate of said diluent and said fuel and communicating the measurements to said dynamic control unit.

12. The apparatus of claim 11, wherein said one or more measuring elements comprise elements dynamically measuring temperature, pressure, and flow rate of said homogenous mixture of diluent and fuel.

13. The apparatus of claim 11, wherein said dynamic control unit is further configured to use said dynamically measured temperature, pressure and flow rate in determining desired diluent flow with a response time faster than that of said main control system of the gas turbine.

14. The apparatus of claim 1, wherein said dynamic control unit is further configured to keep said diluent from mixing with said fuel during startup procedures of said gas turbine combustion system in order to stabilize the combustion process during startup until said gas turbine combustion system reaches a stable condition with load.

15. The apparatus of claim 14, wherein said dynamic control unit is further configured to provide a time delay causing a gradual increase of flow of said diluent that maintains homogeneity during a transition from zero diluent flow to a level of diluent flow set by the dynamic control unit to maintain diluent-to-fuel in a selected ratio.

16. The apparatus of claim 1, wherein said dynamic control unit is configured to operate during shutdown procedures prior to complete shutdown, to gradually decrease the diluent flow mixing with said fuel until there is no diluent flow in the combustion system, and thereafter following a time delay to complete the shutdown procedure of the combustion system.

17. The apparatus of claim 1, wherein said dynamic control unit is further configured to maintain a ratio of diluent-to-fuel in the range of 2.0:1 to 4.2:1.

18. The apparatus of claim 1, wherein said dynamic control unit is further configured to maintain a ratio of diluent to fuel in the range of 2.75:1 to 3.0:1.

19. The apparatus of claim 1, wherein said dynamic control unit is further configured to maintain a ratio of diluent and fuel in the range of 3.7:1 to 4.2:1.

20. The apparatus of claim 1, wherein said dynamic control unit is further configured to cause said homogenous mixture of diluent and fuel when combusted to produce emissions of both CO and $NO_X$ that are below 15 ppm.

21. The apparatus of claim 1, wherein said dynamic control unit is further configured to cause said homogenous mixture of diluent and fuel when combusted to produce emissions of both CO and $NO_X$ that are below 5 ppm.

22. The apparatus of claim 1, wherein said homogenous mixture of diluent and fuel when combusted to produce emissions of both CO and $NO_X$ that are below 2 ppm.

23. The apparatus of claim 1, wherein said dynamic control unit is further configured to selectively cause a power output of said gas turbine combustion system to increase by controlling the proportion of diluent in said mixture.

24. The apparatus of claim 1, wherein said dynamic control unit is further configured to reduce $CO_2$ emissions per kilowatt hour of said gas turbine combustion system by controlling the proportion of diluent in said mixture.

* * * * *